US011289067B2

(12) United States Patent
Brimijoin et al.

(10) Patent No.: US 11,289,067 B2
(45) Date of Patent: Mar. 29, 2022

(54) VOICE GENERATION BASED ON CHARACTERISTICS OF AN AVATAR

(71) Applicant: INTERNATIONAL BUSINESS MACHINES CORPORATION, Armonk, NY (US)

(72) Inventors: Kristina Marie Brimijoin, Hastings on Hudson, NY (US); Gregory Boland, Katonah, NY (US); Joseph Schwarz, New York, NY (US)

(73) Assignee: International Business Machines Corporation, Armonk, NY (US)

( * ) Notice: Subject to any disclaimer, the term of this patent is extended or adjusted under 35 U.S.C. 154(b) by 39 days.

(21) Appl. No.: 16/452,502

(22) Filed: Jun. 25, 2019

(65) Prior Publication Data

US 2020/0410977 A1 Dec. 31, 2020

(51) Int. Cl.
*G10L 13/033* (2013.01)

(52) U.S. Cl.
CPC ..... *G10L 13/033* (2013.01)

(58) Field of Classification Search
CPC ..... G06N 5/02; G06T 13/40; G06T 13/80; G06T 13/205; H04N 7/18; G10L 13/00
See application file for complete search history.

(56) References Cited

U.S. PATENT DOCUMENTS 6,161,091 A * 12/2000 Akamine ..... G10L 19/0018 704/207
6,577,998 B1 * 6/2003 Yamamoto ..... G10L 21/06 704/205
6,919,892 B1 * 7/2005 Cheiky ..... G06T 13/40 345/473
7,027,054 B1 * 4/2006 Cheiky ..... G06T 13/40 345/473
7,228,273 B2 * 6/2007 Okunoki ..... G10L 13/033 704/224
8,224,652 B2 * 7/2012 Wang ..... G06T 13/205 704/275
8,306,824 B2 * 11/2012 Park ..... G10L 21/06 704/270
9,607,609 B2 * 3/2017 Begum ..... G10L 13/033
9,648,376 B2 * 5/2017 Chang ..... H04N 21/431
10,176,519 B2 * 1/2019 Humphreys ..... G06F 3/04815
(Continued)

FOREIGN PATENT DOCUMENTS

WO WO-2016048579 A1 * 3/2016 ..... G06K 9/00315

OTHER PUBLICATIONS

Cabral et al. The Influence of Synthetic Voice on the Evaluation of a Virtual Character, Proc. Interspeech 2017, 229-233, semanticscholar.org. 4 pages.

(Continued)

*Primary Examiner* — Anne L Thomas-Homescu
(74) *Attorney, Agent, or Firm* — Daniel Morris; Otterstedt, Wallace & Kammer, LLP

(57) ABSTRACT

Methods and systems for generating voices based on characteristics of an avatar. One or more characteristics of an avatar are obtained and one or more parameters of a voice synthesizer for generating a voice corresponding to the one or more avatar characteristics are determined. The voice synthesizer is configured based on the one or more parameters and a voice is generated using the parameterized voice synthesizer.

20 Claims, 9 Drawing Sheets

(56) References Cited

U.S. PATENT DOCUMENTS 10,497,361 B1* 12/2019 Rule ..... G10L 13/00
2003/0069997 A1* 4/2003 Bravin ..... G10L 21/06 709/250
2003/0115063 A1* 6/2003 Okunoki ..... G10L 13/00 704/266
2004/0019484 A1* 1/2004 Kobayashi ..... G10L 13/02 704/258
2004/0054519 A1* 3/2004 Kobayashi ..... G10L 13/06 704/1
2004/0073427 A1* 4/2004 Moore ..... G10L 13/08 704/258
2004/0075677 A1* 4/2004 Loyall ..... G06T 13/40 715/706
2005/0102438 A1* 5/2005 Nakagawa ..... G06F 3/002 710/1
2005/0182629 A1* 8/2005 Coorman ..... G10L 13/07 704/266
2007/0129946 A1* 6/2007 Ma ..... G10L 13/027 704/256
2008/0140407 A1* 6/2008 Aylett ..... G10L 13/00 704/260
2010/0083308 A1* 4/2010 Chang ..... H04N 21/4223 725/37
2010/0094634 A1* 4/2010 Park ..... G10L 21/06 704/270
2010/0100828 A1* 4/2010 Khandelwal ..... A63F 13/30 715/757
2010/0100907 A1* 4/2010 Chang ..... G06F 3/01 725/46
2010/0100916 A1* 4/2010 Clayton ..... G06Q 30/0601 725/110
2010/0115427 A1* 5/2010 Schroeter ..... H04N 21/4781 715/757
2011/0141106 A1* 6/2011 Runge ..... G06T 13/40 345/419
2011/0141258 A1* 6/2011 Song ..... G06K 9/00281 348/77
2013/0257877 A1* 10/2013 Davis ..... G06N 3/006 345/473
2014/0152758 A1* 6/2014 Tong ..... H04M 1/72439 348/14.02
2014/0222627 A1* 8/2014 Kukreja ..... G06Q 30/0643 705/27.2
2015/0037771 A1* 2/2015 Kaleal, III ..... A61B 5/0205 434/257
2015/0052084 A1* 2/2015 Kolluru ..... G06T 13/40 706/11
2016/0030744 A1* 2/2016 Hubert-Brierre ..... A61N 1/36039 607/57
2016/0154948 A1* 6/2016 Guo ..... G16H 20/70 705/2
2016/0203123 A1* 7/2016 Kozloski ..... G06F 40/30 704/224
2016/0203827 A1* 7/2016 Leff ..... G06T 13/40 704/207
2016/0269712 A1* 9/2016 Ostrover ..... H04S 7/302
2018/0115645 A1* 4/2018 Iyer ..... G06Q 10/063112
2018/0130459 A1* 5/2018 Paradiso ..... G06T 13/00
2018/0133900 A1* 5/2018 Breazeal ..... B25J 19/026
2018/0336713 A1* 11/2018 Avendano ..... G10L 21/003
2018/0336716 A1* 11/2018 Ramprashad ..... G06F 3/04842
2018/0349108 A1* 12/2018 Brebner ..... H04W 4/80
2019/0103082 A1* 4/2019 Ogasawara ..... G10L 13/033
2019/0115023 A1* 4/2019 Komori ..... G10L 15/30
2019/0204907 A1* 7/2019 Xie ..... A63F 13/424
2019/0251950 A1* 8/2019 Bonada ..... G10L 13/0335
2020/0126283 A1* 4/2020 van Vuuren ..... G10L 13/00
2020/0126556 A1* 4/2020 Mosayyebpour ..... G10L 15/063
2020/0213680 A1* 7/2020 Ingel ..... H04N 21/233
2020/0226844 A1* 7/2020 Chiu ..... H04N 5/272
2020/0285912 A1* 9/2020 Brebner ..... G06K 9/46
2020/0365169 A1* 11/2020 Selvaggi ..... G10L 21/10
2021/0027759 A1* 1/2021 Ogawa ..... G10L 15/26
2021/0150145 A1* 5/2021 Negishi ..... G06F 40/58
2021/0192824 A1* 6/2021 Chen ..... G06F 16/43

OTHER PUBLICATIONS

Wikipedia—Speech synthesis—https://en.wikipedia.org/wiki/Speech_synthesis, page last edited on Nov. 18, 2018 printed Nov. 20, 2018, 18 pages.
Reallusion, Auto Motion, located at https://www.reallusion.com/crazytalk/auto-motion.html, 6 pages downloaded Nov. 20, 2018.
Evans, et al. (2006). Relationships between vocal characteristics and body size and shape in human males: An evolutionary explanation for a deep male voice. Biological psychology. 72. 160-3. 10.1016/j.biopsycho.2005.09.003. Jun. 2006 6 pages.
Inglis-Arkell, Do people of different races have different voices, webpabe located http://io9.gizmodo.com/5928125/dopeopleofdifferentraceshavedifferentvoices, Jul. 23, 2012, downloaded Nov. 21, 2018, 5 pages.
Peter Mell and Timothy Grance, The NIST Definition of Cloud Computing, NIST Special Publication 800-145, Sep. 2011, cover, pp. i-iii and 1-3.
Feldstein, et al. Perception of speech rate as a function of vocal intensity and frequency, Language and Speech 24.4 (1981): 387-394.
Microsoft's facial recognition service, webpage located at https://azure.microsoft.com/en-us/services/cognitive-services/face/ downloaded Apr. 8, 2019, 24 pages.
Avatar service webpage located at https://avatarsdk.com/ downloaded on Apr. 8, 2019, 8 pages.

* cited by examiner

| Physical Characteristic | Vocal Characteristic | Correlation |
|---|---|---|
| Age | Pitch | High (Infants/Children)<br>Decreases with age (Adults < 60)<br>Decreases with age (Females > 60)<br>Increases with age (Males > 60) |
| | Pitch Range | Wide (Infants/Children)<br>More controlled and constant (Adults < 60)<br>More controlled and constant (Adults > 60) |
| | Breathiness / Hoarseness | Initially light (Infants / Children)<br>Constant and stable (Adults < 60)<br>Increases (Adults > 60) |
| | Speaking rate | Slow initially, increases with age (Infants/Children)<br>Faster speaking rate (Adults < 60)<br>Begins to decline (Adults > 60) |
| Height | Tract length | Increases with height |
| Weight | Tract length | Increases with weight |
| Head shape and size | Resonance | Decreases with increased size |
| Physical condition | Breathiness / Hoarseness | Decreases with increased physical condition |
| | Jitter | Decreases with increased physical condition |

*FIG. 3*

| Avatar Characteristics | Voice Synthesizer Parameters |
|---|---|
| Age / Gender<br>70 yo / Male | <voice-transformation type="Custom" glottal_tension="-19%" breathiness="11%" pitch="-37%" pitch_range="-14%" timbre_extent="100%" rate="-21%" hoarseness="12%" growl="0%" tremble="0%" timbre="map {300_300.0_900_900.0_1800_1800.0_4000_4000}"> |
| Age / Gender<br>10 yo / Male | <voice-transformation type="Custom" glottal_tension="-31%" breathiness="-12%" pitch="65%" pitch_range="20%" timbre_extent="100%" rate="12%" hoarseness="0%" growl="0%" tremble="0%" timbre="map {300_490.0_900_1098.0_1800_2298.0_4000_4000}"> |
| Gender - Woman | <voice-transformation type="Custom" glottal_tension="-52%" breathiness="76%" pitch="19%" pitch_range="0%" timbre_extent="100%" rate="-12%" hoarseness="0%" growl="0%" tremble="0%" timbre="map {400_666.0_1200_1296.0_3000_3312.0_4000_4000}"> |
| Gender - Man | <voice-transformation type="Custom" glottal_tension="46%" breathiness="17%" pitch="-69%" pitch_range="65%" timbre_extent="100%" rate="0%" hoarseness="0%" growl="0%" tremble="0%" timbre="map{400_201.99998_1200_876.0_3000_2448.0_4000_4000}"> |
| Height - Tall | <voice-transformation type="Custom" glottal_tension="0%" breathiness="0%" pitch="0%" pitch_range="0%" timbre_extent="100%" rate="11%" hoarseness="0%" growl="0%" tremble="0%" timbre="map {300_279.0_900_813.0_1800_1724.0_4000_4000}"> |
| Height - Short | <voice-transformation type="Custom" glottal_tension="0%" breathiness="0%" pitch="0%" pitch_range="0%" timbre_extent="100%" rate="11%" hoarseness="0%" growl="0%" tremble="0%" timbre="map {300_346.0_900_990.0_1800_1890.0_4000_4000}"> |

*FIG. 4*

VOICE GENERATION BASED ON CHARACTERISTICS OF AN AVATAR

BACKGROUND

The present invention relates to the electrical, electronic and computer arts, and more specifically, to speech synthesis, user interface technologies, and the like.

Avatars are used in a variety of media productions, such as instructional videos, animated movies, and so on. In certain circumstances, a voice actor who is most closely related to the character of an avatar is chosen to perform the voice over work. Acquiring, recording, and implementing human voice talent for applications such as gaming, narration, animations, translation systems, and the like can be costly in both financial and time respects. Thus, this option is not always realistic due to cost, time, and an ability to scale. In addition, knowledge of signal processing and/or audio engineering is needed to add vocal effects and the like to the recorded voice.

These issues are often addressed with speech synthesis. Speech synthesis is the artificial production of human speech, used in text-to-speech systems, for generating entertainment productions (such as voice over content and gaming), and the like. The creators of applications often turn to human voice synthesis as the voice(s) for their characters, such as avatars. Depending on the production, the voices for the avatars may be electronically synthesized, narrated by a human, or may be a combination of human voice and electronic synthesis. Conventional methods for electronically synthesizing a voice involve an impersonal interface of sliders and dials to manipulate vocal properties, dropdown menus of pre-established voices, analyzing the voice of hired voice talent as a basis for the synthetic voice, and the like. These techniques, such as the use of pre-established voices, however, may be disassociated from the character of the avatar. Thus, these techniques often result in a large gap between the physical appearance of the character and the characteristics and quality of the voice, making for a mismatch of the voice and the avatar.

SUMMARY

Principles of the invention provide techniques for voice generation of an avatar. In one aspect, an exemplary method includes the step of obtaining one or more characteristics of an avatar; determining one or more parameters of a voice synthesizer for generating a voice corresponding to the one or more avatar characteristics; configuring the voice synthesizer based on the one or more parameters; and generating a voice using the parameterized voice synthesizer.

In one aspect, a non-transitory computer readable medium comprises computer executable instructions which when executed by a computer cause the computer to perform a method comprising operations of: obtaining one or more characteristics of an avatar; determining one or more parameters of a voice synthesizer for generating a voice corresponding to the one or more avatar characteristics; configuring the voice synthesizer based on the one or more parameters; and generating a voice using the parameterized voice synthesizer.

In one aspect, an apparatus comprises a memory; and at least one processor, coupled to said memory, and operative to perform operations comprising: obtaining one or more characteristics of an avatar; determining one or more parameters of a voice synthesizer for generating a voice corresponding to the one or more avatar characteristics; configuring the voice synthesizer based on the one or more parameters; and generating a voice using the parameterized voice synthesizer.

As used herein, "facilitating" an action includes performing the action, making the action easier, helping to carry the action out, or causing the action to be performed. Thus, by way of example and not limitation, instructions executing on one processor might facilitate an action carried out by instructions executing on a remote processor, by sending appropriate data or commands to cause or aid the action to be performed. For the avoidance of doubt, where an actor facilitates an action by other than performing the action, the action is nevertheless performed by some entity or combination of entities.

One or more embodiments of the invention or elements thereof can be implemented in the form of a computer program product including a computer readable storage medium with computer usable program code for performing the method steps indicated. Furthermore, one or more embodiments of the invention or elements thereof can be implemented in the form of a system (or apparatus) including a memory, and at least one processor that is coupled to the memory and operative to perform exemplary method steps. Yet further, in another aspect, one or more embodiments of the invention or elements thereof can be implemented in the form of means for carrying out one or more of the method steps described herein; the means can include (i) hardware module(s), (ii) software module(s) stored in a computer readable storage medium (or multiple such media) and implemented on a hardware processor, or (iii) a combination of (i) and (ii); any of (i)-(iii) implement the specific techniques set forth herein.

Techniques of the present invention can provide substantial beneficial technical effects. For example, one or more embodiments provide one or more of:

automatic generation of a voice for an avatar;

improved match between generated voice and avatar appearance (e.g. avatar's voice sounds more like what one would commonly expect to hear given the look of the character);

reduction in required operator expertise and experience (e.g. user does not have to have knowledge of signal processing or audio engineering);

efficient review and revision of a generated voice; and efficient review and revision of an avatar.

These and other features and advantages of the present invention will become apparent from the following detailed description of illustrative embodiments thereof, which is to be read in connection with the accompanying drawings.

BRIEF DESCRIPTION OF THE DRAWINGS

FIG. 3 illustrates an example table that correlates voice characteristics and avatar characteristics for an avatar, in accordance with an example embodiment;

FIG. 4 illustrates an example table that correlates avatar characteristics and voice synthesizer parameters for an avatar, in accordance with an example embodiment;

DETAILED DESCRIPTION

Figure 1:
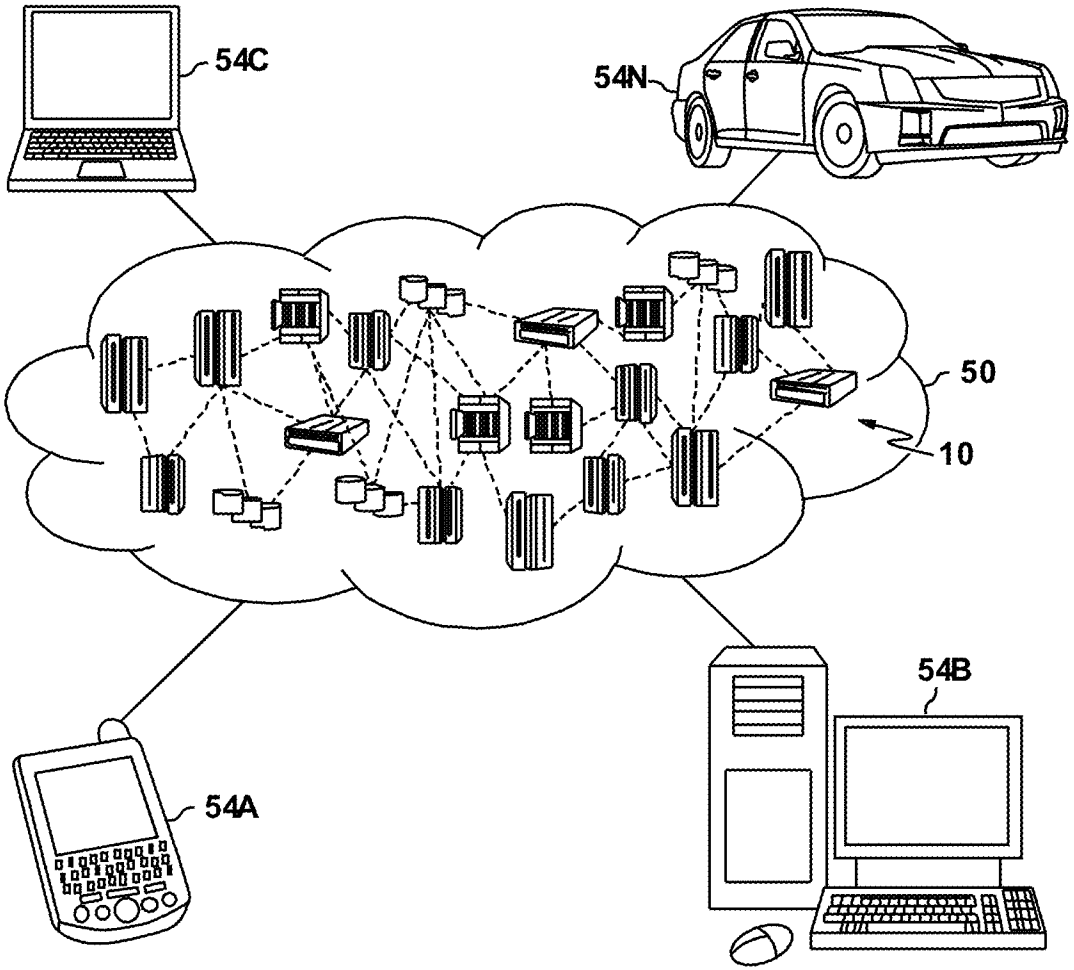
FIG. 1 depicts a cloud computing environment according to an embodiment of the present invention.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
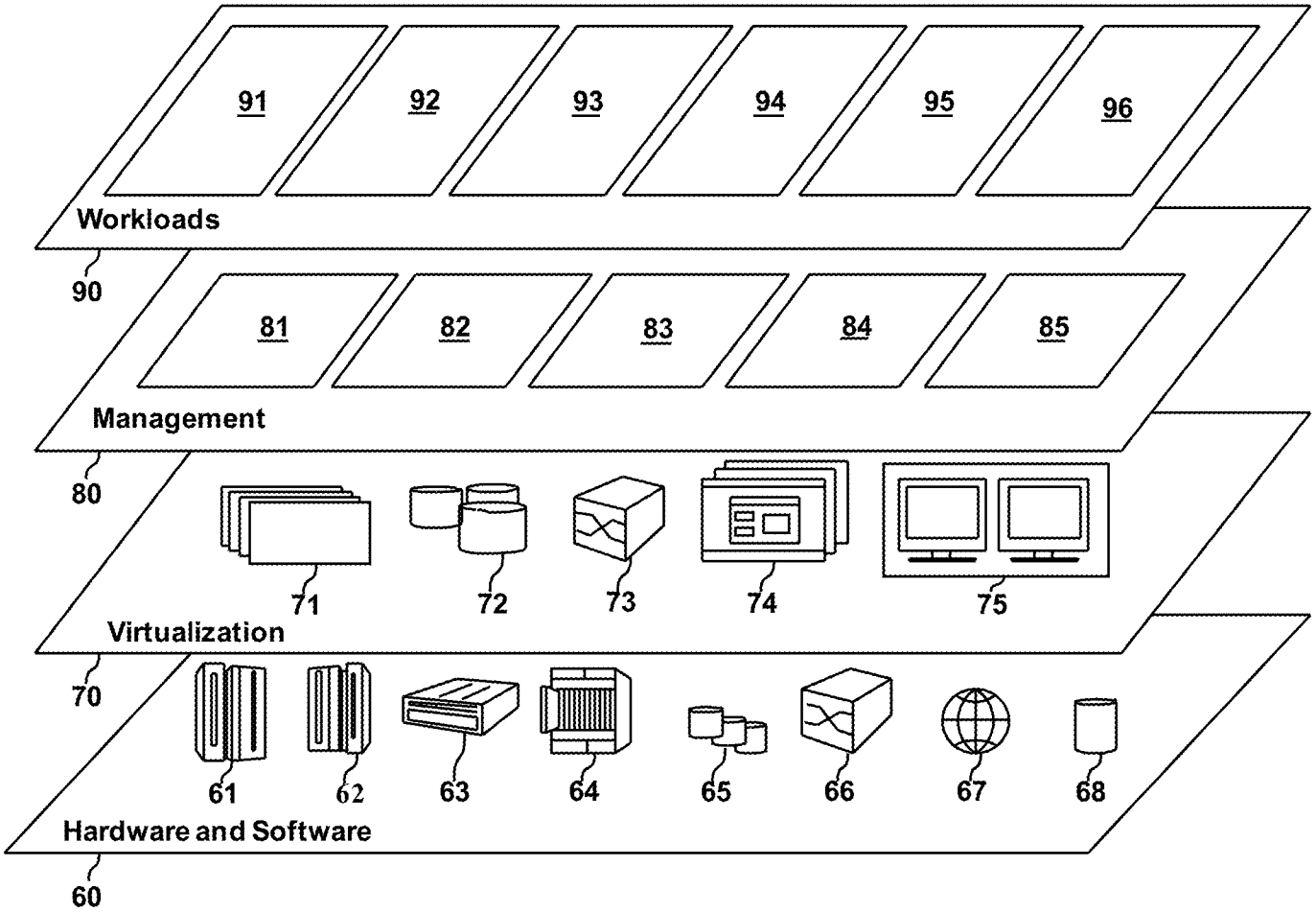
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components.

Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and a web-based service for voice generation 96.

Generally, system(s) and method(s) for generating a voice for an avatar are disclosed. The disclosed techniques generate the voice based on various characteristics of the avatar. For example, the voice can be generated based on physical characteristics (such as nasal characteristics, weight, height, and the like), observed characteristics (such as facial features, height, and the like), assigned characteristics (such as age, gender, demographic parameters, and the like), and so on. The system allows a creator of an avatar to envision his or her character and generate an accurate vocal baseline for the character's voice. For example, a lion may be portrayed as having a bold voice while a bunny may be portrayed as having a meek voice. The disclosed techniques may be applied to avatars representing a variety of animals, humans, fantasy characters, fictional characters, and the like. The generated voice can be reviewed by a user and the vocal characteristics can be adjusted after review. Various effects, such as an echo chamber, can also be applied to the voice. The generated voice provides a realistic correlation of avatar characteristics to voice characteristics, voice quality, and the like.

In one example embodiment, various characteristics of an avatar are obtained. For example, physical and assigned characteristics may be obtained from an avatar profile, as described more fully below in conjunction with FIG. 5. Observed characteristics are obtained by performing image analysis on an image of the avatar. In one example embodiment, a video or other stream of images may be analyzed to determine dynamic characteristics of the avatar, such as mannerisms, a rate of speech (such as words per minute), facial expressions while speaking, and the like. The dynamic characteristics may be utilized to generate the voice. For example, the rate of speech may dictate not only the spoken words per minute for the avatar, but also the pitch, tone, and the like of the speech In one example embodiment, an image is provided to a cloud-based analysis service and the image is analyzed using models representing the human physical characteristics that influence voice quality. For example, the age, gender, and emotional status of an individual may be determined from an analysis of the image. In one example embodiment, the service also reports the pixel location of facial landmarks (such as the pixel location of the mouth-left and mouth-right landmarks) that could presumably be extrapolated into the subject's actual mouth cavity size. Similarly, an image-to-avatar service may be used to extrapolate the subject's physical dimensions.

In one example embodiment, a configuration of a voice synthesizer, including various parameters, is established based on the obtained avatar characteristics. For example, parameters of the voice synthesizer for timbre, breathiness, speed, glottal tension, tone, pitch range, rate, and the like may be set based on the characteristics of the avatar. In one example embodiment, the parameters and configuration are determined by performing a lookup in one or more tables that correlate the characteristics of the avatar with vocal characteristics, the characteristics of the avatar with parameters of the voice synthesizer, or both, as described more fully below in conjunction with FIGS. 3 and 4A-4B.

In one example embodiment, the voice is synthesized following configuration of the voice synthesizer. For example, a text based script may be provided to the voice synthesizer and the voice generated in accordance with the vocal characteristics. The text based script may include directives such as speech style, accent, and the like.

In one example embodiment, the vocal characteristics that are statistically most associated with the recognized characteristics of the avatar are identified. The vocal characteristics may be used to determine the parameters and configuration of the voice synthesizer.

In one example embodiment, a user can designate additional effects for the generated voice. For example, a user can specify a telephone effect (to make it sound as if the avatar is speaking through a telephone), an echo chamber effect, and the like.

In one example embodiment, the parameters and configuration of the voice synthesizer are iteratively refined by a user. For example, a user may listen to the generated voice and may redefine the observed, assigned, and/or physical characteristics of the avatar, may redefine the identified vocal characteristics for the avatar, may redefine the parameters for the voice synthesizer, or any combination thereof.

In one example embodiment, a default or given avatar is obtained and the facial and/or bodily characteristics of the avatar are modified by a user. Non-limiting example characteristics include age, weight, gender, eyebrow shape (implying emotion), nasal congestion (as in a cold), and the like. For example, an avatar for a tiger may be made younger, thinner, taller, and the like. The system then modifies the vocal characteristics of the avatar (such as the timbre, breathiness, speed, glottal tension, pitch range, rate, and the like) in accordance with the modified facial and/or bodily characteristics of the avatar, as described more fully above.

FIG. 3 illustrates an example table that correlates voice characteristics and avatar characteristics for an avatar, in accordance with an example embodiment. The mapping of the vocal characteristics in the table of FIG. 3 to the parameters used in the text-to-speech synthesizer is based on the following mappings:

pitch→pitch
pitch range→pitch_range
breathiness→breathiness
hoarseness→hoarseness
speaking rate→rate
tract length→timbre
resonance→glottal tension
jitter→tremble Note that timbre takes a mapped value of frequencies which is represented in the examples. When creating these mappings, the user may define what the characteristics of the base male and female voices are as well as the incremental/decremental steps that occur in each trait change, as long as the changes follow the correct correlation described in the table of FIG. 3.

FIG. 4 illustrates an example table that correlates avatar characteristics and voice synthesizer parameters for an avatar, in accordance with an example embodiment. For example, the voice for a 70 year old (yo) man would be configured as follows: glottal_tension=−19%; breathiness=11%; pitch=−37% pitch_range=−14%; timbre_extent=100%; rate=−21%; hoarseness=12%; growl=0%; and tremble=0%. The voice for a 10 year old (yo) boy would be configured as follows: glottal_tension=−31%; breathiness=−12%; pitch=65%; pitch_range=20%; timbre_extent=100%; rate=12%; hoarseness=0%; growl=0%; and tremble=0%. In addition, as illustrated in FIG. 4, the frequencies in the timbre map are higher as the vocal tract length is shorter for the height-short vocal characteristics; frequencies in the timbre map are lower as the vocal tract length is longer for the height-tall vocal characteristics.

Figure 5:
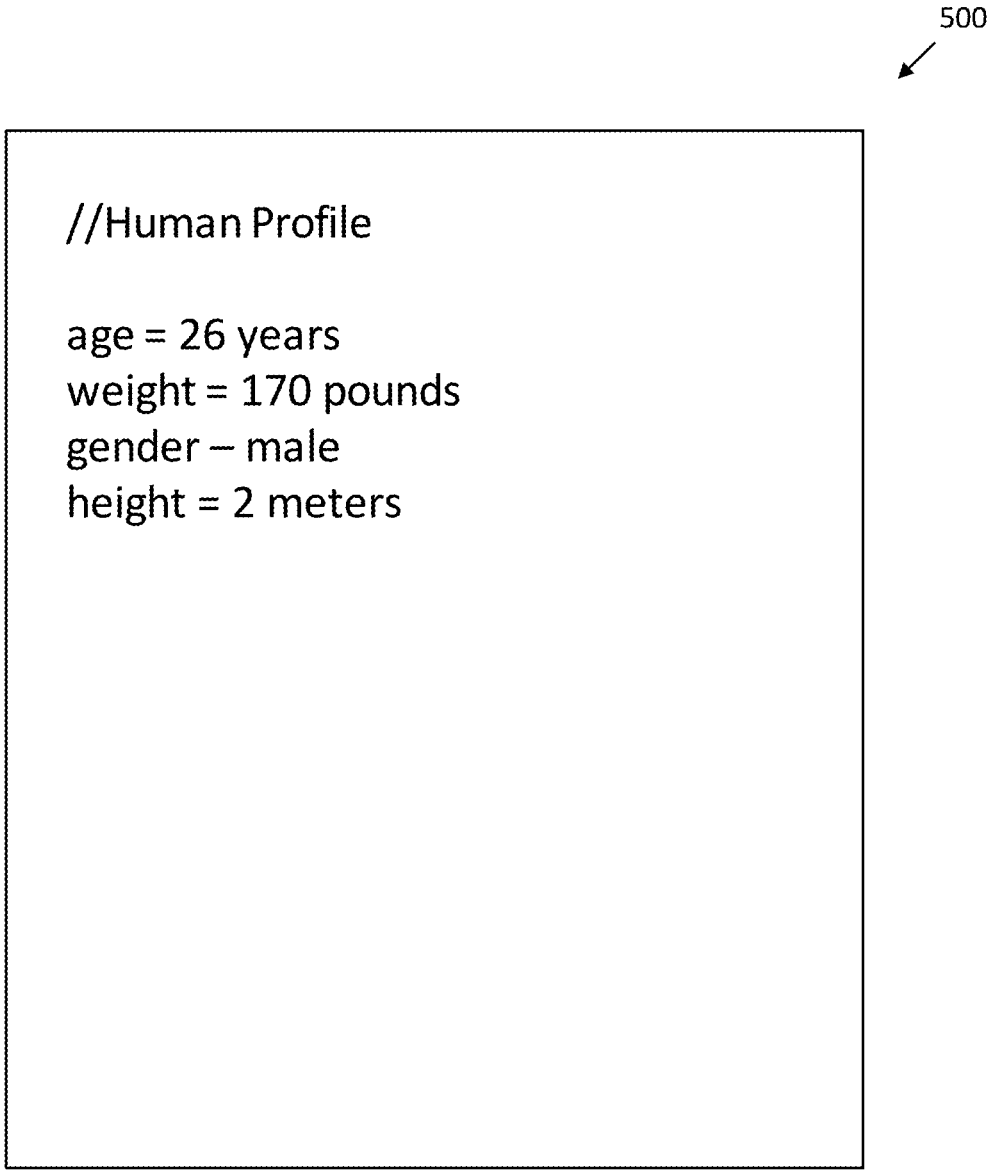
FIG. 5 is an example profile for an avatar, in accordance with an example embodiment.

FIG. 5 is an example profile 500 for an avatar, in accordance with an example embodiment. As illustrated in FIG. 5, the avatar represents a human. The age of the human is twenty-six years, the weight is 170 pounds, the gender is male, and the height is 2 meters.

Figure 6A:
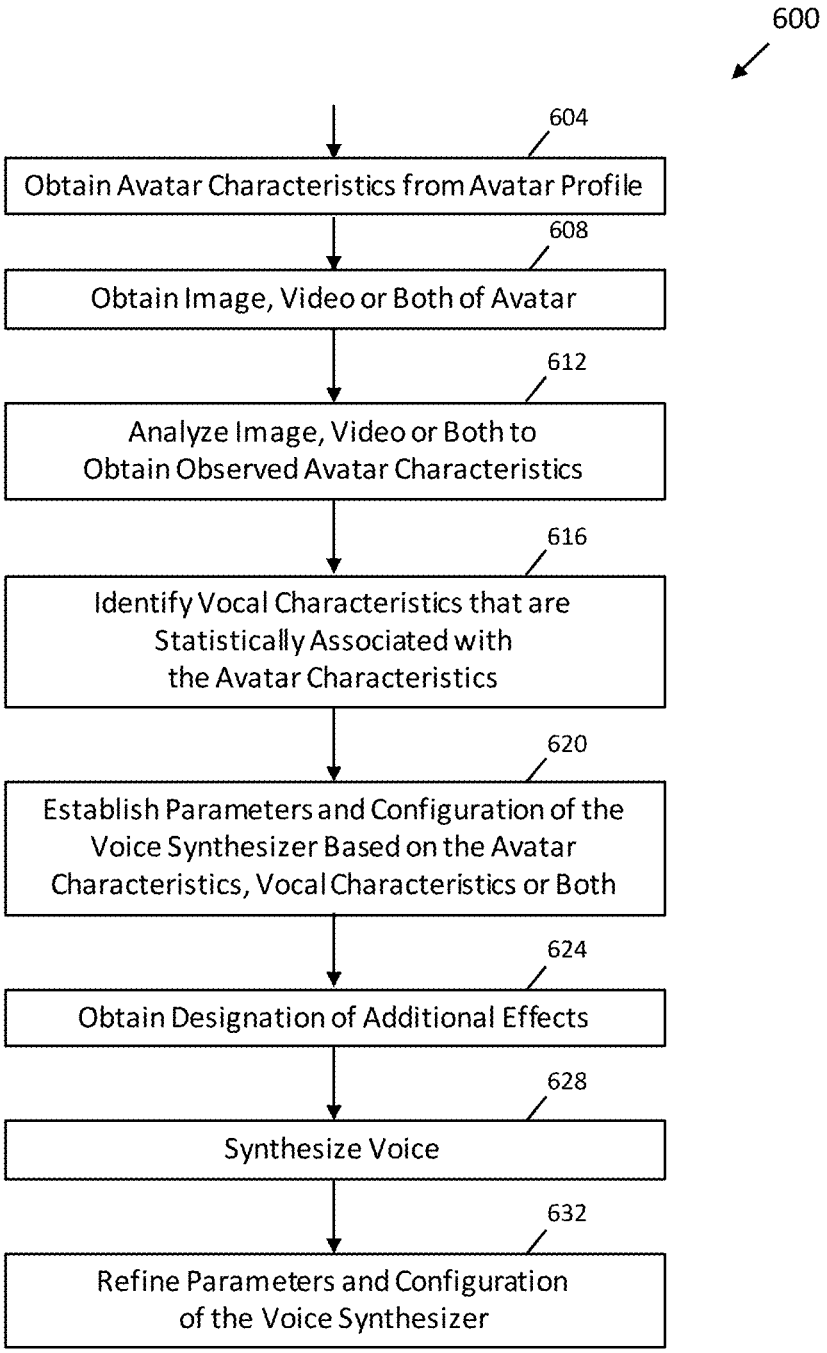
FIG. 6A is a flowchart of a first example method for configuring a voice synthesizer, in accordance with an example embodiment.

FIG. 6A is a flowchart of a first example method 600 for configuring a voice synthesizer, in accordance with an example embodiment. In one example embodiment, various characteristics of an avatar are obtained from an avatar profile (operation 604). For example, physical characteristics (such as nasal characteristics, weight, and the like) and assigned characteristics (such as age, gender, demographic parameters, and the like) may be extracted from the avatar profile of FIG. 5.

In one example embodiment, an image, video, or both of an avatar are obtained (operation 608) and the image, video, or both are analyzed to identify the observed characteristics (such as facial features, height, mannerisms, rate of speech (such as words per minute), facial expressions while speaking, and the like) (operation 612).

In one example embodiment, the vocal characteristics that are statistically most associated with the recognized characteristics of the avatar are identified (operation 616).

In one example embodiment, a configuration of a voice synthesizer, including various parameters, are established based on the obtained avatar characteristics, the identified vocal characteristics, or both (operation 620). For example, parameters of the voice synthesizer for timbre, breathiness, speed, glottal tension, tone, pitch range, rate, and the like may be set based on the characteristics of the avatar. In one example embodiment, the parameters and configuration are determined by performing a lookup in a table(s) that correlates the characteristics of the avatar with vocal characteristics, the vocal characteristics with the parameters of the voice synthesizer, or both, as described in conjunction with FIGS. 3 and 4A-4B.

In one example embodiment, the designation of additional effects for the generated voice are obtained (operation 624). For example, a user can specify a telephone effect (to make it sound as if the avatar is speaking through a telephone), an echo chamber effect, and the like.

In one example embodiment, the voice is synthesized following configuration of the voice synthesizer (operation 628). For example, a text based script may be provided to the voice synthesizer and the voice generated in accordance with the vocal characteristics. The text based script may include directives such as speech style, speech emphasis, and the like.

In one example embodiment, the parameters and configuration of the voice synthesizer are iteratively refined by a user (operation 632). For example, a user may listen to the generated voice and may redefine the observed, assigned, and/or physical characteristics of the avatar, may redefine the identified vocal characteristics for the avatar, may redefine the parameters for the voice synthesizer, or any combination thereof.

Figure 6B:
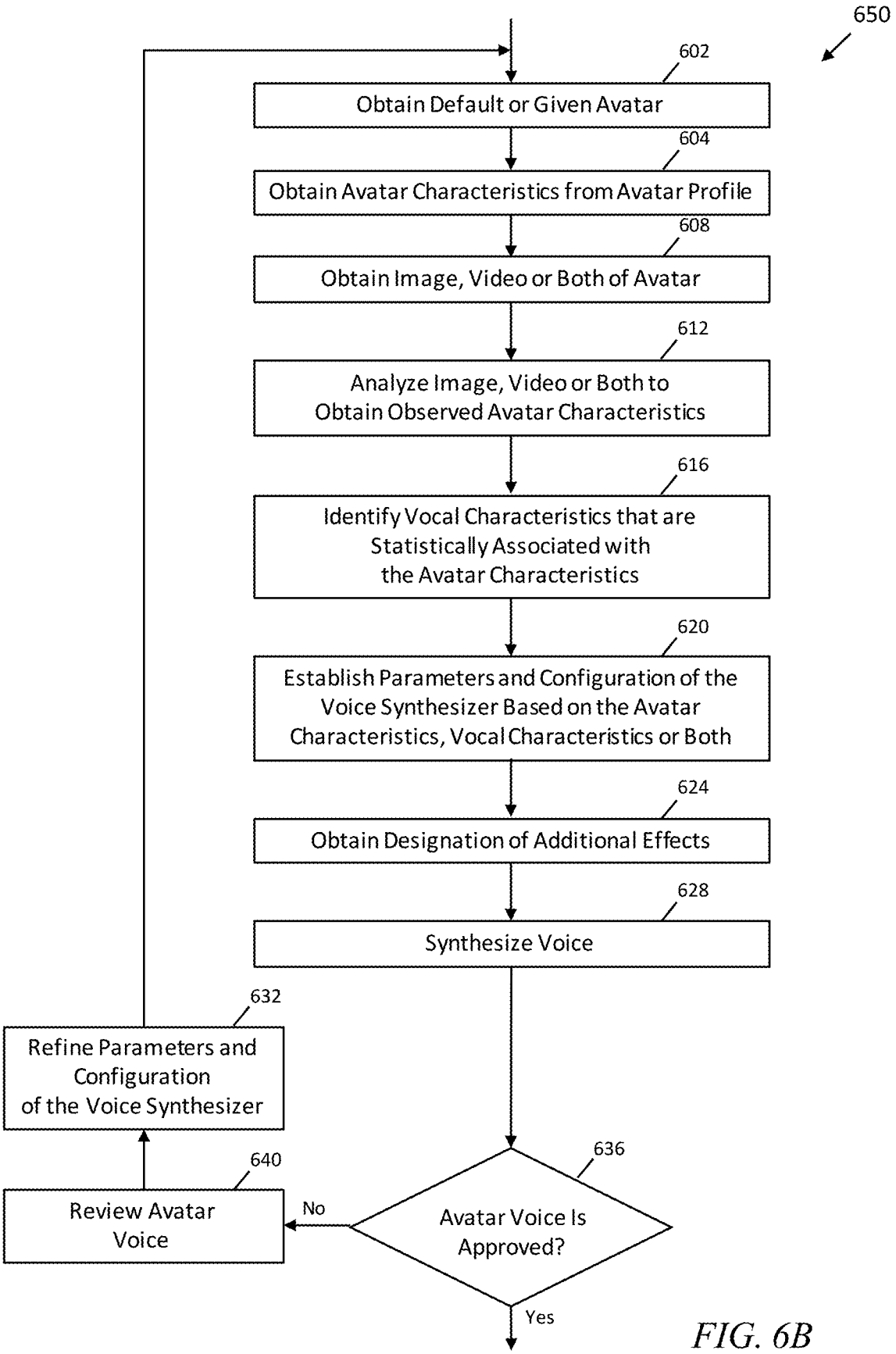
FIG. 6B is a flowchart of a second example method for configuring a voice synthesizer, in accordance with an example embodiment.

FIG. 6B is a flowchart of a second example method 650 for configuring a voice synthesizer, in accordance with an example embodiment. The operations of the method 650 are similar to the operations of the method 600, except a default or given avatar is obtained at operation 602. Operations 604 through 628, described above, are performed to generate the avatar voice, which is reviewed by a user at operations 636, 640. If the voice is not approved, the user then has the opportunity to modify the facial and/or bodily characteristics of the avatar at operation 632. The method 650 then repeats operations 604 through 628 to modify the vocal characteristics of the avatar (such as the timbre, breathiness, speed, glottal tension, pitch range, rate, and the like) in accordance with the modified facial and/or bodily characteristics of the avatar and/or other modifications as per 632. If the voice is approved (YES branch of decision block 636), the method is complete.

Figure 7:
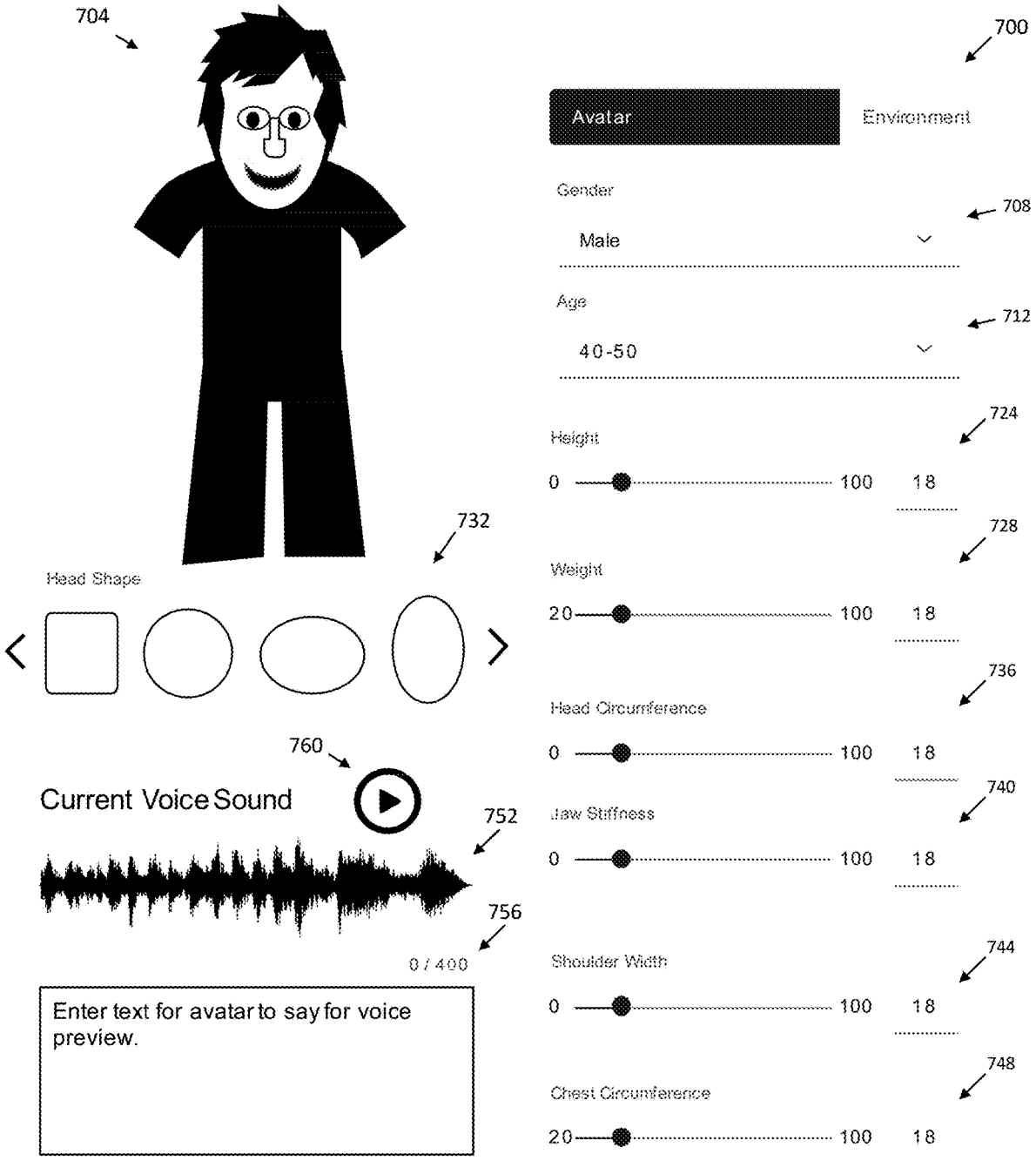
FIG. 7 illustrates and example user interface for defining characteristics of an avatar, in accordance with an example embodiment.

FIG. 7 illustrates an example user interface 700 for defining characteristics of an avatar, in accordance with an example embodiment. Window 704 shows a graphical representation of an avatar and enables a user to manipulate physical characteristics of the avatar by dragging and dropping the avatar's physical features on a graphical representation of the avatar. The physical characteristics may also be entered via controls 708-748. Control 708 enables a user to select the avatar's gender; control 712 enables a user to select the avatar's age (or age range); control 724 enables a user to select the height of the avatar; control 728 enables a user to select the weight of the avatar; control 732 enables a user to select the shape of the avatar's head; control 736 enables a user to select the circumference of the avatar's head; control 740 enables a user to select the stiffness of the avatar's jaw; control 744 enables a user to select the width of avatar's shoulders; and control 748 enables a user to select the circumference of avatar's chest. A text field 756 enables a user to enter a string of text to be synthesized into a voice based on the characteristics of the avatar, as defined by window 704 and/or controls 708-748. Once the voice has been synthesized, it may be played by selecting a play control 760. A graphical representation of the voice is displayed as current voice sound 752. The skilled artisan will appreciate that many physical characteristics of a human contribute to the human's vocal sound, as is documented in the scientific literature; the characteristics shown in FIG. 7 are non-limiting examples and additional and/or alternative characteristics could be utilized in other embodiments.

Given the discussion thus far, it will be appreciated that, in general terms, an exemplary method, according to an aspect of the invention, includes the step of obtaining one or more characteristics of an avatar (operations 604-612); determining one or more parameters of a voice synthesizer for generating a voice corresponding to the one or more avatar characteristics (operations 616-620); configuring the voice synthesizer based on the one or more parameters (operation 620); and generating a voice using the parameterized voice synthesizer (operation 628).

In one aspect, a non-transitory computer readable medium comprises computer executable instructions which when executed by a computer cause the computer to perform a method comprising operations of: obtaining one or more characteristics of an avatar (operations 604-612); determining one or more parameters of a voice synthesizer for generating a voice corresponding to the one or more avatar characteristics (operations 616-620); configuring the voice synthesizer based on the one or more parameters (operation 620); and generating a voice using the parameterized voice synthesizer (operation 628).

In one aspect, an apparatus comprises a memory; and at least one processor, coupled to said memory, and operative to perform operations comprising: obtaining one or more characteristics of an avatar (operations 604-612); determining one or more parameters of a voice synthesizer for generating a voice corresponding to the one or more avatar characteristics (operations 616-620); configuring the voice synthesizer based on the one or more parameters (operation 620); and generating a voice using the parameterized voice synthesizer (operation 628).

In one example embodiment, one or more vocal characteristics corresponding to the one or more avatar characteristics are determined (operation 616). In one example embodiment, the one or more vocal characteristics corresponding to the one or more avatar characteristics are determined by performing a table lookup. In one example embodiment, the determining of the one or more parameters of the voice synthesizer is based on the one or more vocal characteristics. In one example embodiment, the one or more parameters of the voice synthesizer are determined by performing a table lookup. In one example embodiment, an avatar is obtained, characteristics of the avatar are modified, and the determining, configuring, and generating operations are repeated using the modified characteristics and a corresponding modified avatar (operation 632). In one example embodiment, one or more additional effects for the generated voice are applied (operation 624).

Figure 8:
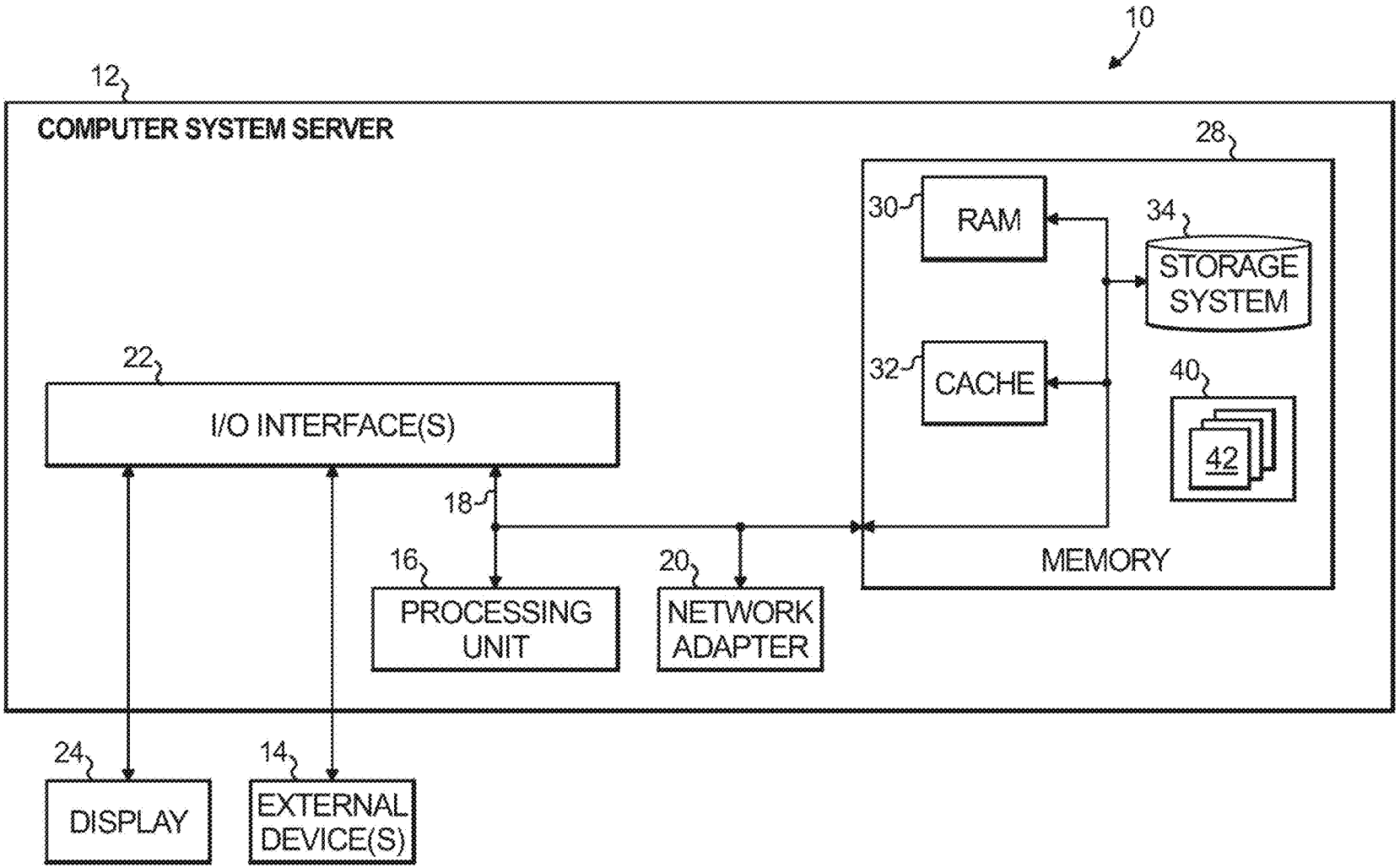
FIG. 8 depicts a computer system that may be useful in implementing one or more aspects and/or elements of the invention, also representative of a cloud computing node according to an embodiment of the present invention.

One or more embodiments of the invention, or elements thereof, can be implemented in the form of an apparatus including a memory and at least one processor that is coupled to the memory and operative to perform exemplary method steps. FIG. 8 depicts a computer system that may be useful in implementing one or more aspects and/or elements of the invention, also representative of a cloud computing node according to an embodiment of the present invention. Referring now to FIG. 8, cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 8, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, and external disk drive arrays, RAID systems, tape drives, and data archival storage systems, etc.

Thus, one or more embodiments can make use of software running on a general purpose computer or workstation. With reference to FIG. 8, such an implementation might employ, for example, a processor 16, a memory 28, and an input/output interface 22 to a display 24 and external device(s) 14 such as a keyboard, a pointing device, or the like. The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory) 30, ROM (read only memory), a fixed memory device (for example, hard drive 34), a removable memory device (for example, diskette), a flash memory and the like. In addition, the phrase "input/output interface" as used herein, is intended to contemplate an interface to, for example, one or more mechanisms for inputting data to the processing unit (for example, mouse), and one or more mechanisms for providing results associated with the processing unit (for example, printer). The processor 16, memory 28, and input/output interface 22 can be interconnected, for example, via bus 18 as part of a data processing unit 12. Suitable interconnections, for example via bus 18, can also be provided to a network interface 20, such as a network card, which can be provided to interface with a computer network, and to a media interface, such as a diskette or CD-ROM drive, which can be provided to interface with suitable media.

Accordingly, computer software including instructions or code for performing the methodologies of the invention, as described herein, may be stored in one or more of the associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 16 coupled directly or indirectly to memory elements 28 through a system bus 18. The memory elements can include local memory employed during actual implementation of the program code, bulk storage, and cache memories 32 which provide temporary storage of at least some program code in order to reduce the number of times code must be retrieved from bulk storage during implementation.

Input/output or I/O devices (including but not limited to keyboards, displays, pointing devices, and the like) can be coupled to the system either directly or through intervening I/O controllers.

Network adapters 20 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 12 as shown in FIG. 8) running a server program. It will be understood that such a physical server may or may not include a display and keyboard.

One or more embodiments can be at least partially implemented in the context of a cloud or virtual machine environment, although this is exemplary and non-limiting. Reference is made back to FIGS. 1-2 and accompanying text.

It should be noted that any of the methods described herein can include an additional step of providing a system comprising distinct software modules embodied on a computer readable storage medium; the modules can include, for example, any or all of the appropriate elements depicted in the block diagrams and/or described herein; by way of example and not limitation, any one, some or all of the modules/blocks and or sub-modules/sub-blocks described. The method steps can then be carried out using the distinct software modules and/or sub-modules of the system, as described above, executing on one or more hardware processors such as 16. Further, a computer program product can include a computer-readable storage medium with code adapted to be implemented to carry out one or more method steps described herein, including the provision of the system with the distinct software modules.

One example of user interface that could be employed in some cases is hypertext markup language (HTML) code served out by a server or the like, to a browser of a computing device of a user. The HTML is parsed by the browser on the user's computing device to create a graphical user interface (GUI).

Exemplary System and Article of Manufacture Details

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method comprising:

obtaining one or more characteristics of a given avatar;

determining one or more parameters of a voice synthesizer for generating a voice that conforms to the one or more avatar characteristics;

configuring the voice synthesizer based on the one or more parameters; and generating a voice using the parameterized voice synthesizer;

wherein:

the obtaining of one or more characteristics of the given avatar comprises obtaining at least one of shoulder width of said given avatar and chest circumference of said given avatar; and in the determining of the one or more parameters of the voice synthesizer for generating the voice that conforms to the one or more avatar characteristics, the parameters cause the voice to conform to the at least one of shoulder width of said given avatar and chest circumference of said given avatar.

2. The method of claim 1, further comprising determining one or more vocal characteristics corresponding to the one or more avatar characteristics.

3. The method of claim 2, wherein the determining the one or more parameters of the voice synthesizer is based on the one or more vocal characteristics.

4. The method of claim 1, further comprising obtaining an avatar, modifying characteristics of the avatar, and repeating the determining, configuring, and generating operations using the modified characteristics and a corresponding modified avatar.

5. The method of claim 1, wherein the one or more avatar characteristics comprise at least one dynamic characteristic, and wherein at least one of the dynamic characteristics is a mannerism of the given avatar.

6. The method of claim 1, wherein the one or more avatar of comprise at least one dynamic characteristic, and wherein at least one of the dynamic characteristics is a rate of speech of the given avatar.

7. The method of claim 1, wherein the one or more avatar characteristics comprise at least one dynamic characteristic, and wherein at least one of the dynamic characteristics is a facial expression of the given avatar while speaking.

8. A non-transitory computer readable medium comprising computer executable instructions which when executed by a computer cause the computer to perform a method comprising operations of:

obtaining one or more characteristics of a given avatar;

determining one or more parameters of a voice synthesizer for generating a voice that conforms to the one or more avatar characteristics;

configuring the voice synthesizer based on the one or more parameters; and generating a voice using the parameterized voice synthesizer;

wherein:

the obtaining of one or more characteristics of the given avatar comprises obtaining at least one of shoulder width of said given avatar and chest circumference of said given avatar; and in the determining of the one or more parameters of the voice synthesizer for generating the voice that conforms to the one or more avatar characteristics, the parameters cause the voice to conform to the at least one of shoulder width of said given avatar and chest circumference of said given avatar.

9. The non-transitory computer readable medium of claim 8, the operations further comprising determining one or more vocal characteristics corresponding to the one or more avatar characteristics.

10. The non-transitory computer readable medium of claim 9, wherein the determining the one or more parameters of the voice synthesizer is based on the one or more vocal characteristics.

11. The non-transitory computer readable medium of claim 8, the operations further comprising obtaining an avatar, modifying characteristics of the avatar, and repeating the determining, configuring, and generating operations using the modified characteristics and a corresponding modified avatar.

12. An apparatus comprising:

a memory; and at least one processor, coupled to said memory, and operative to perform operations comprising:

obtaining one or more characteristics of a given avatar;

determining one or more parameters of a voice synthesizer for generating a voice that conforms to the one or more avatar characteristics;

configuring the voice synthesizer based on the one or more parameters; and generating a voice using the parameterized voice synthesizer;

wherein:

the obtaining of one or more characteristics of the given avatar comprises obtaining at least one of shoulder width of said given avatar and chest circumference of said given avatar; and in the determining of the one or more parameters of the voice synthesizer for generating the voice that conforms to the one or more avatar characteristics, the parameters cause the voice to conform to the at least one of shoulder width of said given avatar and chest circumference of said given avatar.

13. The apparatus of claim 12, the operations further comprising determining one or more vocal characteristics corresponding to the one or more avatar characteristics.

14. The apparatus of claim 13, wherein the determining the one or more parameters of the voice synthesizer is based on the one or more vocal characteristics.

15. The apparatus of claim 12, wherein the one or more parameters of the voice synthesizer are determined by performing a table lookup.

16. The apparatus of claim 12, the operations further comprising obtaining an avatar, modifying characteristics of the avatar, and repeating the determining, configuring, and generating operations using the modified characteristics and a corresponding modified avatar.

17. The apparatus of claim 12, the operations further comprising applying one or more additional effects for the generated voice.

18. The apparatus of claim 12, wherein the one or more avatar characteristics comprise at least one dynamic characteristic, and wherein at least one of the dynamic characteristics is a mannerism of the given avatar.

19. The apparatus of claim 12, wherein the one or more avatar characteristics comprise at least one dynamic characteristic, and wherein at least one of the dynamic characteristics is a rate of speech of the given avatar.

20. The apparatus of claim 12, wherein the one or more avatar characteristics comprise at least one dynamic characteristic, and wherein at least one of the dynamic characteristics is a facial expression of the given avatar while speaking.

* * * * *